US010648108B2

(12) United States Patent
Barea

(10) Patent No.: US 10,648,108 B2
(45) Date of Patent: May 12, 2020

(54) METHOD FOR MONITORING AND CONTROLLING THE SUPPLY OF A THREAD TO A TEXTILE MACHINE AND SUPPLY DEVICE THEREOF

(71) Applicant: BTSR INTERNATIONAL S.p.A., Olgiate Olona, Varese (IT)

(72) Inventor: Tiziano Barea, Varese (IT)

(73) Assignee: BTSR INTERNATIONAL S.p.A., Olgiate Olona, Varese (IT)

( * ) Notice: Subject to any disclaimer, the term of this patent is extended or adjusted under 35 U.S.C. 154(b) by 22 days.

(21) Appl. No.: 16/098,752

(22) PCT Filed: May 4, 2017

(86) PCT No.: PCT/IB2017/052587
§ 371 (c)(1),
(2) Date: Nov. 2, 2018

(87) PCT Pub. No.: WO2017/191584
PCT Pub. Date: Nov. 9, 2017

(65) Prior Publication Data

US 2019/0135574 A1 May 9, 2019

(30) Foreign Application Priority Data

May 5, 2016 (IT) ..... 102016000046419

(51) Int. Cl.
*D04B 15/48* (2006.01)
*B65H 59/40* (2006.01)
(Continued)

(52) U.S. Cl.
CPC ..... *D04B 15/482* (2013.01); *B65H 51/20* (2013.01); *B65H 59/40* (2013.01); *B65H 63/06* (2013.01)

(58) Field of Classification Search
CPC ..... D04B 15/66; D04B 37/00; D04B 37/02; D04B 15/486; D04B 15/482;
(Continued)

(56) References Cited

U.S. PATENT DOCUMENTS 5,277,373 A * 1/1994 Morton ..... B65H 59/385 226/44
7,493,188 B2 * 2/2009 Minakata ..... D04B 15/48 66/125 R
(Continued)

FOREIGN PATENT DOCUMENTS

WO 2012/066416 A1 5/2012
WO 2013/088233 A1 6/2013
WO 2013/164749 A1 11/2013

OTHER PUBLICATIONS

International Search Report and Written Opinion of the International Searching Authority for International Patent Application No. PCT/IB2017/052587.

*Primary Examiner* — Danny Worrell
(74) *Attorney, Agent, or Firm* — Merchant & Gould P.C.

(57) ABSTRACT

A method monitors/controls unwinding and supplying thread from a supply device to a textile machine. The supply device includes a control unit and a thread collection and supply unit moved by a motor. A first sensor detects first data indicative of a current driving torque applied to the collection and supply unit. A second sensor detects second data indicative of a current tension value of thread supplied to the textile machine. A first indicator representing driving torque values is calculated, each variation of the first indicator representing a variation of the driving torque value to compensate for a deviation of the first data. A second indicator is calculating representing tension values applied to the thread supplied to the textile machine. Each variation of the second indicator representing a deviation of the
(Continued)

second data. Based on the indicators, malfunctions in the unwinding and supply of thread are detected and signaled.

25 Claims, 5 Drawing Sheets

(51) Int. Cl.
*B65H 63/06* (2006.01)
*B65H 51/20* (2006.01)

(58) Field of Classification Search
CPC .... B65H 59/387; B65H 59/385; B65H 59/40; B65H 51/22; B65H 51/20; B65H 63/06
USPC ..... 700/141; 66/125 R, 131, 132 R, 146
See application file for complete search history.

(56) References Cited

U.S. PATENT DOCUMENTS

| | | | | |
|---|---|---|---|---|
| 8,249,739 | B2 * | 8/2012 | Nishitani | D04B 15/48 66/125 R |
| 9,834,403 | B2 * | 12/2017 | Barea | B65H 59/385 |
| 2011/0010002 | A1 * | 1/2011 | Minami | D04B 15/50 700/141 |
| 2013/0228643 | A1 * | 9/2013 | Barea | D04B 15/48 242/487.2 |
| 2014/0291435 | A1 * | 10/2014 | Barea | D04B 15/482 242/417 |
| 2015/0129705 | A1 * | 5/2015 | Barea | B65H 59/385 242/418.1 |

* cited by examiner

METHOD FOR MONITORING AND CONTROLLING THE SUPPLY OF A THREAD TO A TEXTILE MACHINE AND SUPPLY DEVICE THEREOF

This application is a National Stage Application of PCT/IB2017/052587, filed 4 May 2017, which claims the benefit of Ser. No. 102016000046419, filed 5 May 2016 in Italy, and which applications are incorporated herein by reference. To the extent appropriate, a claim of priority is made to each of the above-disclosed applications.

TECHNICAL BACKGROUND OF THE INVENTION

Field of Application

The present invention relates to a method for monitoring and controlling the supply of a thread to a textile machine, in particular at constant tension and speed, configured to detect malfunctions in the unwinding of the thread from a reel and in the supply of the thread to the textile machine. A further object of the invention is a supply device improved for implementing the above method.

Prior Art

In the field of textile machines for industrial production, during the process of supplying a thread to a textile machine by means of a known type of supply devices there is the need to ensure that the yarn supply tension and/or the supply speed or amount of supplied thread (LFA) from the supply device is maintained substantially constant. This allows, in fact, to improve the quality of the manufactured textile products.

In particular, besides the purpose of controlling the unwinding of a thread from a reel and maintaining constant the tension of the outputting thread from the supply device, to intercept any nodes in the thread itself is required.

Devices of the known type configured to intercept the presence of nodes on the thread supplied to a textile machine are operatively associated with the thread supply devices so as to be interposed between the reel and the supply devices themselves.

The most common of said nodes intercepting devices comprise a mechanical thread clearer consisting of a metal plate including one or more radial slits, each having a pre-set width, through which the thread is passed. In particular, the width of each slit of the thread clearer is indicative of the minimum diameter of the node to be intercepted: nodes with a diameter smaller than the width of a pre-set slit are passed through the thread clearer; nodes with a larger diameter are blocked by the thread clearer, often causing the breakage of the thread supplied to the textile machine.

Other devices known for the same purposes include a thread clearer structurally similar to the preceding, but of a movable type. When the diameter of the node exceeds the width of the slit selected by the thread clearer, the node interception causes a movement, for example a rotation, of the thread clearer itself. A specific processing unit provided in the supply device is configured to detect such a rotation to stop the textile machine without causing the breakage of the thread.

Both of the above-mentioned types of known nodes intercepting devices provide for the stoppage of the textile machine following the interception of a node by the thread clearer and require the intervention of an operator on the supply device to remedy the malfunction.

However, such devices are not able to detect other drawbacks which may arise during the process of the unwinding of the thread from the reel, in particular, in the case of processes involving natural fibers (cotton, wool). In these cases, in fact, the passage of the yarn through an input portion of the supply device can cause the formation of debris generated by the friction between the yarn and the mechanical parts of such input portion of the supply device. These debris tend to accumulate on the thread clearer, and with the passing of time, the accumulation of debris tends to hinder the passage of the thread even up to cause the breakage of the thread itself. This compromises the quality of the finished product manufactured by the textile machine.

In relation to the necessity to keep constant the tension of the thread output from the supply device, supply devices are known, both of the positive and of the storage type, configured to measure and control variations of the thread tension with respect to a pre-set reference tension.

Such functionality of the known supply devices is adapted to detect macro-defects in the process of supplying the thread to the textile machine, such as, for example, the not correct threading of the thread in the supply device or the breakage of the thread itself. However, such a functionality is not suitable to detect short-term malfunctions in the thread tension, i.e., tension peaks, or to provide an indication on the fluctuation of the tension output from the supply device and therefore the quality of the thread supply process and the manufactured product. The failure to recognize such malfunctions can lead therefore to the production of defective garments.

It is therefore apparent that, as for the supply of a thread to a textile machine, in particular at a constant tension/speed, a technique is not available which allows to detect simultaneously both the malfunctions on the thread supply from the reel to the supply device, caused by the accumulation of debris at an input portion to the supply device itself, and the tension peaks or the fluctuations in the tension of the thread supplied to the textile machine at an output portion from the supply device.

In addition, during the process of supplying the thread to the machine, the need is also felt to detect any defects downstream to the supply device such as the breakage of a needle into the textile machine or the presence of a bent needle.

Currently, optical type sensors (generally laser or optic fiber sensors) are known, configured to detect this type of defects. Such sensors are generally associated to the textile machine, placed in proximity of the needles to be monitored.

These sensors suffer, however, the inconvenience of being difficult to be installed on textile machines, in particular on small and average diameter machines, due to the considerable dimensions associated with those sensors which badly fit to the small spaces which are available in the vicinity of the needles. It should be noted that the spaces near the needles of the machine are delimited from mechanical organs responsible for tissue processing and they can not be excessively reduced to allow an operator to always be able to intervene on the machine for threading and maintenance, both ordinary and extraordinary. Furthermore, the known sensors are often difficult to be calibrated, in particular to intercept a bent needle.

SUMMARY OF THE INVENTION

The object of the present invention is to devise and provide a method and a device thereof for monitoring and controlling the supply of a thread to a textile machine, in particular at constant tension and/or speed, which allows to at least partially overcome the drawbacks noted above in relation to the known methods, in particular, allows to detect simultaneously both the malfunctions on the thread supply caused by the accumulation of debris at an input portion to the supply device, and the tension peaks or the fluctuations in the tension of the thread supplied to the textile machine at an output portion of the supply device.

BRIEF DESCRIPTION OF THE DRAWINGS

Further characteristics and advantages of the method and device according to the invention will be apparent from the description below of preferred embodiments, given by way of non-limiting example, with reference to the appended figures, wherein.

In the above mentioned figures the same or similar elements will be indicated by the same reference numbers.

DETAILED DESCRIPTION OF THE PREFERRED EMBODIMENTS

Figure 1:
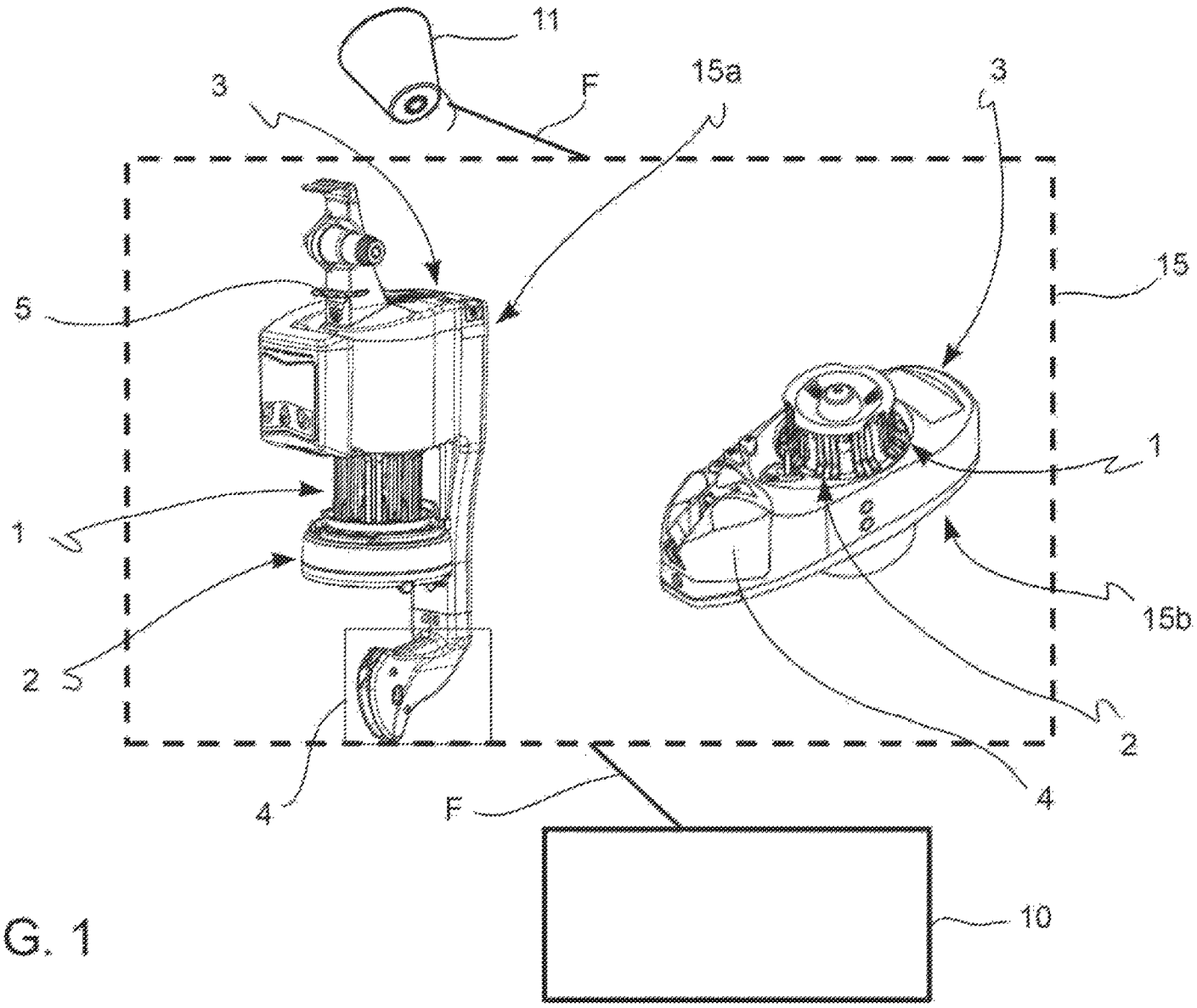
FIG. 1 illustrates schematically two examples of supply devices used for the unwinding of a thread from a reel and for supplying said thread to a textile machine and configured to operate according to the method of the present invention.

With reference to FIG. 1, a system for supplying a yarn F to a textile machine 10 configured to operate according to the method of the invention, comprises a supply device of thread F or supply device 15 configured to pick up the yarn or thread F from a reel or spool 11 to supply it to the textile machine 10.

In the present invention, with the general term supply device or, briefly, supplier 15 reference will be made indifferently both to a supply device of the type with constant tension accumulation 15*a* (Unifeeder) and to a constant tension/speed supply device 15*b* (Ultrafeeder) or positive supply device both of a known type to an expert of the field.

In greater detail, the supply device 15 comprises an electronic control unit 3, which is implemented, for example, by a microprocessor or microcontroller unit, provided with a respective memory, housed on an electronic board of printed circuit (PCB) enclosed by the supply device casing.

In addition, the supply device 15 comprises a thread collection and supply unit 1 configured to facilitate the winding of the thread drawn from the reel 11. Said thread collection and supply unit 1 is moved by a respective electric motor driven by the electronic control unit 3. Said thread collection and supply unit 1 is implemented, for example, by a drum, a wheel, a pulley, a reel, etc.

In addition, the supply device 15 comprises first sensor means 2 associated with the thread collection and supply unit 1 and electrically connected to the electronic control unit 3. Said first sensor means are configured to detect a first piece of data d1 indicative of a current value of driving torque applied to the thread collection and supply unit 1.

The supply device 15 also comprises second sensor means 4 electrically connected to the electronic control unit 3. Said second sensor means are configured to detect a second piece of data d2 indicative of a current tension value of the thread F supplied to the textile machine 10.

In an exemplary embodiment, said second sensor means comprise a load cell 4.

With reference to the thread supply device 15*a*, said device includes a mechanical thread clearer 5 configured to intercept the presence of nodes on the thread F unwound from the reel 11 to be supplied to the textile machine 10. Said mechanical thread clearer 5 is of the type known to a person skilled in the art and it will not be further described in the following.

During the normal operational phase of the supply device 15, on the basis of said first piece of data d1, the electronic control unit 3 is configured to control in real time the rotational speed of the electric motor which moves the thread collection and supply unit 1. In particular, the electronic control unit 3 is configured to adjust a driving torque T required to run such a motor at the pre-set speed in order to maintain substantially constant the quantity of the thread F wound on the drum 1 in the case of an accumulation supply device 15*a* or to maintain a constant thread unwinding tension/speed in the case of a positive supply device 15*b*.

Similarly, on the basis of said second piece of data d2, the electronic control unit 3 is configured to control the tension of the thread supplied to the textile machine 10 in real time.

In general, the method of the invention provides for the calculation, by the electronic control unit 3, of a first numeric indicator TI representative of the unwinding quality of the thread F from the reel 11 from which the thread is drawn to be loaded on the drum of the supply device 15. Further, the method provides for the calculation, always by the control unit 3, of a second numeric indicator QI representative of the tension quality of the output thread.

Through these indicators TI and QI, the electronic unit 3 of the supply device 15 is able to control everything that happens downstream or upstream of the supply device itself, reporting to the operator any malfunctions of the thread supply process or stopping the textile machine 10.

Figure 2:
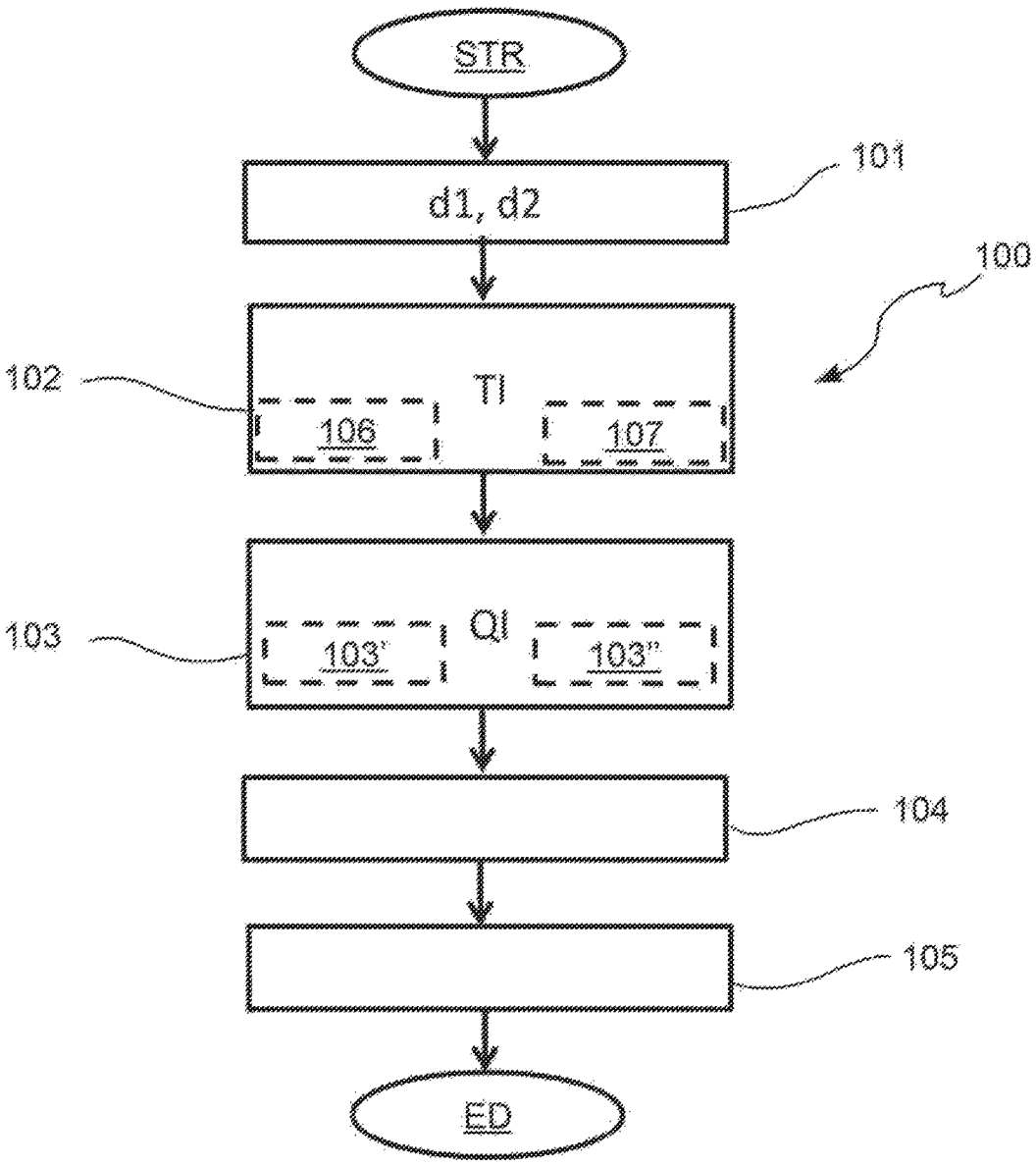
FIG. 2 illustrates a flowchart of the method for monitoring and controlling the supply of a thread to a textile machine according to the invention.

With reference to FIG. 2, the method 100 of the present invention is described in greater detail. It should be noted that the following method steps are performed in a continuous manner during an operation time interval of the supply device 15. The algorithm of the method comprises a symbolic start-up step STR and ends with a symbolic end step ED. It should be noted that the algorithm can be implemented through an appropriate computer program loadable on a memory of the supply device 15.

In a first step 101, the first piece of data d1 and the second piece of data d2 taken through the first and second 4 sensor means are provided to the electronic control unit 3.

In a second step 102, the electronic control unit calculates the first numeric indicator TI representative of the driving torque values T applied to the electric motor for moving the thread collection and supply unit 1.

Each variation of the first numeric indicator TI in the operation time interval of the supply device 15 is representative of a change in the driving torque value T applied to the motor to compensate for a deviation of the first piece of data d1 detected from a first reference value of the pre-set driving torque d1ref.

In a third step 103, the electronic control unit 3 calculates the second numeric indicator QI representative of the tension values applied to the thread supplied to the textile machine 10.

Each change of the second numeric indicator QI in the operation time interval of the supply device 15 is representative of a deviation of the second piece of data d2 detected by the load cell 4 from a second pre-set reference value d2ref of the tension of the thread supplied to the textile machine 10.

In a fourth step 104 of the method, the electronic control unit 3 detects, based on an analysis of the first TI and second QI numeric indicator, malfunctions in the unwinding of the thread F from the reel 11 and in the supply of the thread to the textile machine 10.

Subsequently, a signaling 105 is expected, by the electronic control unit 3, of the occurrence of said malfunctions.

It should be noted that the electronic control unit 3 which controls the rotation speed of the thread collection and supply unit 1, is configured to vary the driving torque T applied by the motor to maintain constant said speed.

From this, it follows that the driving torque value T is a function of the rotation speed and of the effort that the motor must fulfil to draw the thread F from the reel 11. In the case where the frictions present between the reel 11 and the supply device 15 grow or the unwinding tension of the thread F increases from the reel 11, the control algorithm provides for an increase of the driving torque T employed to maintain the rotation speed of the thread collection and supply unit 1 aligned to the thread withdrawal speed by the textile machine 11. In this way, the thread supply of the thread collection and supply unit 1 is maintained substantially constant.

In view of the above, a first example of a performance malfunction in the unwinding of the thread F from the reel 11, such as an accumulation of debris near the mechanical thread clearer 5, tends to obstruct the free passage of the thread F. This determines an increase of frictions during the loading of the thread F on the collection and supply unit 1. To counteract these frictions and maintain the motor speed to desired values, the electronic control unit 3 is, therefore, configured to increase in an automatic manner the torque T applied to the motor.

A second example of the malfunction in the unwinding of the thread F occurs in the case of a defective reel 11 which has a high unwinding tension, constant or discontinuous. Even in this case, to counteract this second malfunction, the electronic control unit 3 is configured to increase the torque applied to the motor to maintain the motor itself rotation speed on the same desired values.

Such increments of the driving torque T generated at the occurrence of the first or second malfunction, are advantageously detectable through the analysis of the above-mentioned first numeric indicator TI. In particular, the electronic control unit 3 by monitoring the first numeric indicator TI and verifying the trend thereof is able to detect the malfunctions in the unwinding of the thread F which occur at an upstream portion of the supply device 15.

In a first exemplary embodiment of the method of the invention, the aforementioned step of calculating 102 the first numeric indicator TI comprises a step 106 of equalizing 106 this first numeric indicator TI to an average value of the driving torque applied by the electric motor for moving the thread collection and supply unit 1 of the supply device 15.

In a second exemplary embodiment of the method, said step of calculating 102 the first numeric indicator TI comprises a step of equalizing 107 the first numeric indicator TI to a deviation from an average value of an instantaneous value of the driving torque applied by the electric motor for moving the thread collection and supply unit 1. In this case, the method of the invention advantageously allows to detect abrupt and sudden changes in the driving torque value applied to the electric motor.

In a particularly advantageous exemplary embodiment of the method, the above-mentioned step of detecting 104 malfunctions comprises a step of detecting a first type and a second type of malfunction. For example, the first type of malfunction is defined as a minor malfunction which does not necessarily require the stoppage of the textile machine 10. With second type of malfunction is meant, instead, a more serious malfunction which requires the stoppage of the textile machine 10.

In addition, the step of signaling the occurrence of said malfunctions comprises a step of providing a first type and a second type of signaling. For example, the first and second type of signaling are selected from the group consisting of:

- sending a warning (WARNING) upon occurrence of the malfunction,
- stopping (ERROR) the textile machine 10.

In greater detail, the aforementioned step of sending a warning comprises a step of activating visual signaling means provided on the supply device 15, for example, led blinking.

In one embodiment, the step of detecting the first type of malfunction in the unwinding of the thread F from the reel 11 comprises the steps of:

- defining 108 a first reference threshold S1 for the values of the first numeric indicator TI;
- comparing 109, in a continuous manner in the operation time interval of the supply device 15, by the electronic control unit 3, the values of the first numeric indicator TI calculated with the first threshold S1;
- detecting the first type of malfunction on the basis of this comparison.

In greater detail, the step of signaling the occurrence of said first type of malfunction in the unwinding of the thread F from the reel 11 comprises the step to provide the first type of signaling in the case where the values of the first numeric indicator TI exceed the first threshold S1.

It should be noted that upon exceeding the first threshold S1, the operator can choose the type of signaling, i.e. whether to send a warning (WARNING) to report the malfunction or stopping (ERROR) the machine.

In an exemplary embodiment, the step of detecting the second type of malfunction in the unwinding of the thread F from the reel 11 comprises the steps of:

- defining 110 a second reference threshold S2 for the values of the first numeric indicator TI greater than the first threshold S1;
- comparing 111, in a continuous manner in the operation time interval of the supply device (15), by the electronic control unit (3), the values of the first numeric indicator TI calculated with the second threshold S2;
- detecting the second type of malfunction on the basis of that comparison.

In particular, the step of signaling the occurrence of the second type of malfunction in the unwinding of the thread F from the reel 11 comprises the step of providing the second type of signaling in the case where the values of the first numeric indicator TI exceed said second threshold S2.

In a different exemplary embodiment of the method of the invention, the step of signaling the occurrence of the first type of malfunction in the unwinding of the thread F from the reel 11 comprises the steps of:

defining 112 a first time interval t1 within the operation time interval of the supply device 15, wherein said first time interval t1 has a first duration D;

providing 113 the first type of signaling in the case where the values of the first numeric indicator TI exceed the first threshold S1 for a second time interval t1' having a duration less than the duration D of the first time interval t1.

In addition, the step of signaling the occurrence of the second type of malfunction in the unwinding of the thread F from the spool 11 comprises the step of providing the second type of signaling in the case where the values of the first numeric indicator TI exceed the first threshold S1 for a third time interval t1" having a duration greater than the duration D of the first time interval t1.

In an advantageous exemplary embodiment, the step of calculating 103 the second numeric indicator QI comprises the steps of:

calculating 103', starting from the second piece of data d2 detected by the load cell 4, instantaneous and averaged values of the measured tension of the thread F supplied to the textile machine 10;

calculating 103" an average fluctuation and an instantaneous fluctuation of the tension of the thread F.

Said second numeric indicator QI coincides with a deviation of the instantaneous tension fluctuation of the thread F from the average fluctuation.

Similarly to what described with reference to the indicator TI, in relation to the second numeric indicator QI, the step of detecting 104 the first kind of malfunction of the thread F to the textile machine 10 of the invention method comprises the steps of:

defining 114 a third reference threshold S3 for the values of the second numeric indicator QI;

comparing 115, in a continuous manner in the operation time interval of the supply device 15, by the electronic control unit 3, the values of the calculated second numeric indicator QI with said third threshold S3;

detecting said first type of malfunction based on said comparison.

In particular, the step of signaling the occurrence of the first type of malfunction in the supply of the thread F to the textile machine 10 comprises the step of providing the first type of signaling in the case where the values of the second numeric indicator QI exceed the third threshold S3.

In an exemplary embodiment, the step of detecting the second type of malfunction in the supplying of the thread F to the textile machine 10 comprises the steps of:

defining 116 a fourth reference threshold S4 for the values of the second numeric indicator QI greater than said third threshold S3;

comparing 117, in a continuous manner in the operation time interval of the supply device 15, by the electronic control unit 3, the values of the calculated second numeric indicator QI with said fourth threshold S4;

detecting said second type of malfunction based on said comparison.

In particular, the step of signaling the occurrence of the second type of malfunction in the supplying of the thread F to the textile machine 10 comprises the step of providing the second type of signaling in the case where the values of the second numeric indicator QI exceed the fourth threshold S4.

In a different embodiment, the step of signaling the occurrence of the first type of malfunction in the supplying of the thread F to the textile machine 10 comprises the steps of:

defining 118 a further first time interval ta within the operation time interval of the supply device 15, where said further first time interval ta has a first duration D';

providing 119 the first type of signaling in the case where the values of the second numeric indicator QI exceed the third threshold S3 for a further second time interval ta' having duration less than the first duration D' of the further first time interval ta.

In an exemplary embodiment of the method, the step of signaling the occurrence of the second type of malfunction in the supplying of the thread F comprises the step of providing the second type of signaling in the case where the values of the second numeric indicator QI exceed the third threshold S3 for a further third time interval ta' having a duration greater than the first duration D' of the further first time interval (ta).

It should be noted that the threshold values S1, S2, S3, S4 mentioned above are pre-set or programmable. Similarly, the duration D, D' of the first t1 and the further first ta time interval is pre-set or programmable.

Figure 3B:
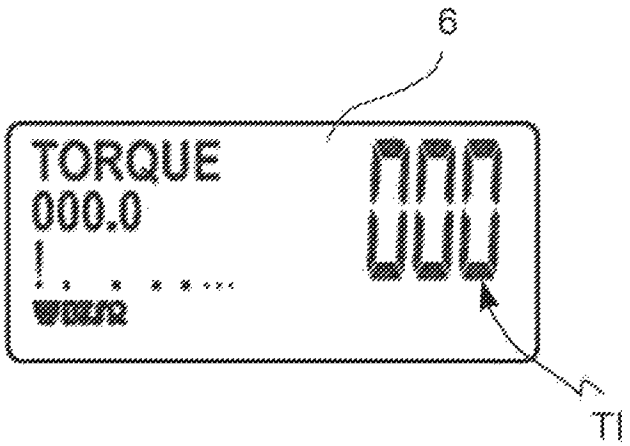
FIGS. 3A-3B schematically illustrate a display associated with one of the supply devices of FIG. 1 on which a first and a second numeric indicator of the invention are shown in an operative condition of the supply device, active and inactive, respectively.
Figure 3A:
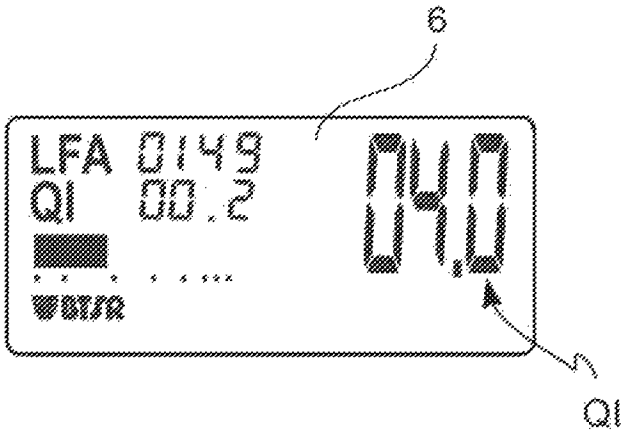

With reference to FIGS. 3A and 3B, in an advantageous example, the method of the invention also comprises a step of displaying 120 the first TI and the second QI numeric indicator on display interface means 6 associated with the supply device 15*a* or associated with multimedia devices for controlling the productive process connected to the supply device. In particular, said multimedia devices are selected in the group consisting of:

a tablet, a laptop, a smartwatch.

In addition, the step of signaling the occurrence of a malfunction in the unwinding of the thread F from the reel 11 or in the supply of the thread to the textile machine 10 of the present method advantageously comprises also a step of transmitting 121, by the electronic control unit 3, a piece of multimedia warning information on display interface means 6 associated with the supply device 15 or associated with multimedia devices for controlling the productive process connected to the supply device. Said multimedia devices are selected in the group consisting of:

a tablet, a laptop, a smartwatch.

In light of the above, for example with reference to the first numeric indicator TI, once the first S1 and the second S2 threshold of comparison, or the first threshold S1 and the duration D, D' of the first t1 and the further first to time interval are set, the electronic control unit 3 is configured to:

signaling (for example, with a programmable led blinking) the occurrence of a malfunction resulting from the accumulation of dirt, and then notifying in advance the possible formation of a node;

stopping the textile machine 10 before the breakage of the thread, allowing an operator to remove the problem without compromising the quality of the finished product;

reporting the process of accumulation of dirt and/or the presence of a node through a notification on a multimedia device for the control of the production process.

It should be noted that from the analysis of the values assumed by the first TI and by the second QI numeric indicator, the method of the invention advantageously allows to detect malfunctions or defects present downstream of the supply device 15, such as the presence of a broken or bent needle in the textile machine 10.

Figure 4:
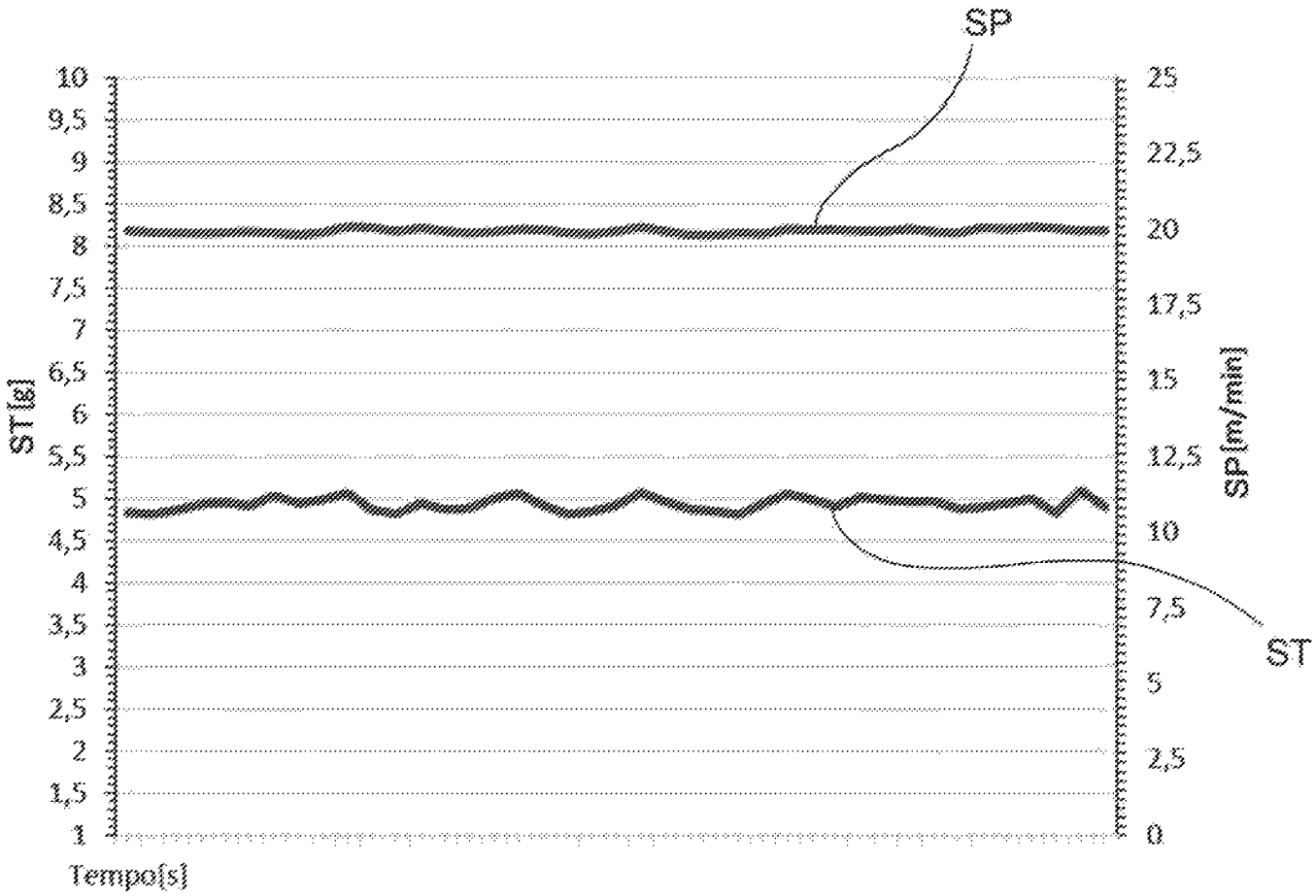
FIG. 4 illustrates, as a function of time, graphs indicative of trends of the tension and of the thread supply speed in the case where the tension is coincident with the tension set in the processing stage.

In particular, it is assumed that the supply device 15 operates at a constant speed, i.e. without selections and with constant consumption of the thread F. Said supply device 15 is configured to maintain the thread tension substantially coincident with a pre-set tension value. This is seen in particular from FIG. 4 which illustrates, as a function of time, graphs indicative of trends of the ST tension (measured in grams) of the thread F and of the supply speed SP of the thread to the textile machine (measured in meters per minute). In particular, to a substantially constant supply speed SP of the thread corresponds a tension ST trend substantially constant as well.

This general operating condition can be defined as "standard."

In a first operating condition, it is assumed that the cylinder of the textile machine spins at a fixed speed, for example equal to about 250 m/min. In addition, it is assumed that the supply device 15 is able to compensate for a variation of the thread tension dictated by different absorptions by the textile machine 10. Consequently, this first operating condition is characterized by a perfectly compensated supply device 15.

In the case of deformation or breakage of a needle into the machine 10, the Applicant has noticed that a malfunction in the absorption of the thread F is recorded with relative increase/decrease of the current I (in mAmpere) supplied to the electric motor of the supply device 15 for maintaining the thread tension ST substantially constant.

Figure 5A:
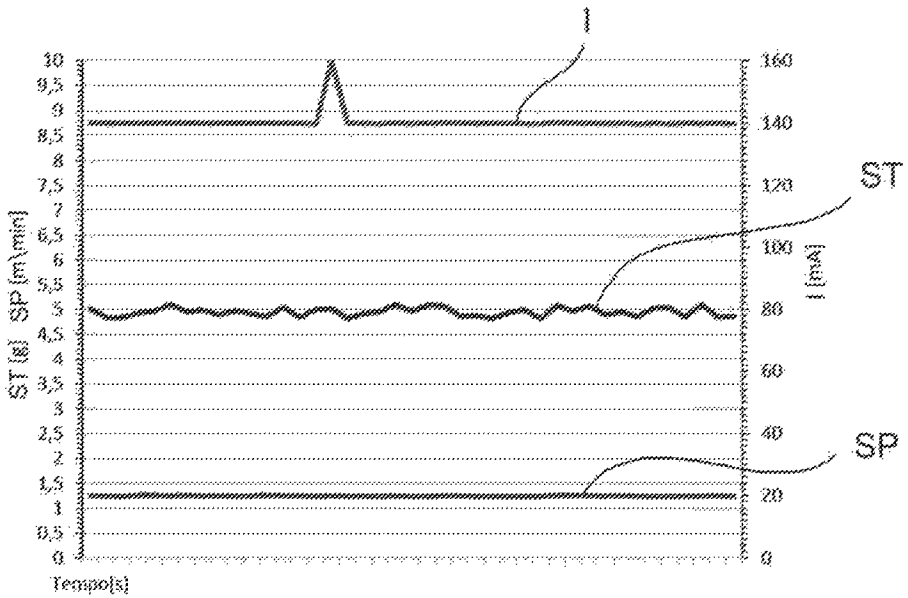
FIGS. 5A and 5B illustrate graphs indicative of the trends of the tension and of the thread supply speed and the current absorbed by the supply device in the presence of malfunction in the thread supply.

In particular, FIG. 5A illustrates such a situation where, in light of substantially constant trends of the tension ST of the thread F and of the supplying speed SP of the thread, an increase (peak) of the current I which the control electronics 3 is adapted to provide with to the electric motor of the supply device 15 is recorded.

Since the speed of the cylinder of the machine 10 is fixed, the presence of a broken or deformed needle involves a periodic registration (for each cylinder revolution of v=250 m/min or submultiples) of the variation of said current I.

It should be noted that the variation of the current I supplied to the motor of the supply device 15 results in a corresponding variation of the driving torque T applied by the motor. As mentioned above, a torque variation is detectable through an analysis of the first numeric indicator TI which, consequently, presents periodic variations. In other words, from the analysis of the variations of the first numeric indicator TI is possible to identify with certainty the occurrence of the malfunction due to the presence of a broken or deformed needle into the textile machine 10.

In a second operating condition, it is always assumed that the cylinder of the machine 10 spins at a fixed speed, for example v=250 m/min. In addition, unlike the previous case, it is assumed that the supply device 15 is not able to perfectly compensate for a variation of the tension ST of the thread dictated by different absorptions by the textile machine 10. Consequently, this second operating condition is characterized by a not perfectly compensated supply device 15.

Figure 5B:
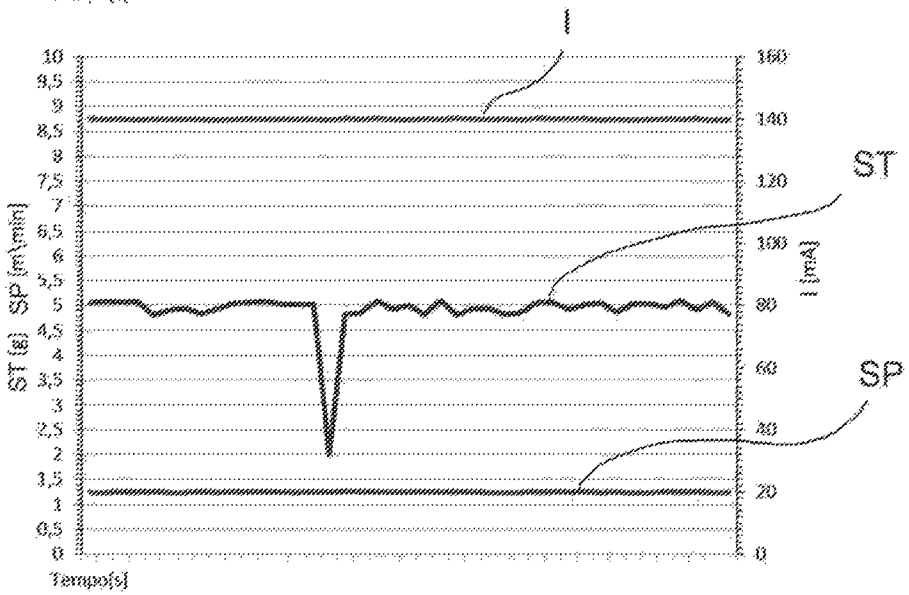

In the case of deformation or breakage of a needle into the machine 10, the Applicant has noticed that a malfunction in the absorption of the thread F with relative decrease of the tension ST is recorded. In particular, FIG. 5B illustrates such a situation where, in light of substantially constant trends of the speed SP of the supply of the thread and of the current I absorbed by the motor of the supply device 15, a rapid decrease and a subsequent sudden increase of the tension ST of the thread F (a negative peak generally followed by a positive peak) is recorded.

Given that the speed of the machine cylinder is fixed, the presence of a broken or deformed needle into the machine 10 involves a periodic recording (for each cylinder revolution of v=250 m/min or submultiples) of said tension variation ST.

It should be noted that the variation of the tension ST of the thread F supplied to the machine 10 is detectable through the load cell 4 of the supply device and results in a corresponding variation of the second numeric indicator QI which, consequently, will also present periodic variations.

In other words, from the analysis of the variations of the second numeric indicator QI is possible to identify with certainty the occurrence of the malfunction due to the presence of a broken or deformed needle or of any other malfunction in the organs responsible for the formation of the stitch (sinkers, hooks) in the machine in this second operating condition.

Since both the first TI and the second QI numeric indicator are programmable, the monitoring method of the present invention can be implemented advantageously by synchronizing the supply device 15 with the textile machine 10 to analyse the synchronism around the cylinder of the machine itself. Knowing the number of needles present in the machine 10, it is possible to locate the exact position of the broken needle, simplifying the intervention of the operator for the replacement of one and/or more damaged elements.

As noted above, the monitoring and control method 100 of the present invention and the supply device 15 thereof which implements the method have numerous advantages and achieve the intended purposes.

In particular, as for the supply of a thread to a textile machine, a technique is provided that allows to detect simultaneously both the malfunctions on the supply of the thread F from the reel 11 to the supply device 15, caused by the accumulation of debris at an input portion to the supply device itself, both the tension peaks or fluctuations in the tension of the thread supplied to the textile machine 10 at an output portion from the supply device 15.

The described method allows to monitor, control and signal the formation and/or the presence of a node in the thread F. In addition, it allows to control the quality of the tension of the thread F, intercepting any dirt accumulations, wear, slippage of the organs responsible for the tensioning of the thread itself.

In addition, during the process of supplying the thread to the machine 10, the method allows to detect defects downstream of the supply device 15 such as the breakage of a needle in the textile machine 10 or the presence of a bent needle or a malfunction of other organs responsible for the formation of the stitch.

In addition, the method described allows to prevent the intervention of maintenance and recovery of the textile machine processing parameters (mechanical or otherwise) by the operator, provides a solution without additional costs with respect to the installation of one and/or more supply devices on one and/or more textile machines, provides a quality control on the production process of the textile machine without adding mechanical components but using the processing parameters of one and/or more supply devices.

A person skilled in the art may make changes and adaptations to the embodiments of the method of the invention, or may replace elements with others which are functionally equivalent in order to satisfy contingent needs without departing from the scope of the following claims. Each of the characteristics described as belonging to a possible embodiment can be realized independently from the other described embodiments.

The invention claimed is:

1. A method for monitoring and controlling unwinding of a thread from a reel and for supplying said thread to a textile machine by a supply device, said supply device comprising:

an electronic control unit;

a thread collection and supply unit configured to assist the winding of the thread from the reel, said thread collection and supply unit being moved by an electric motor driven by the electronic control unit;

a first sensor associated with the thread collection and supply unit and electrically connected to the electronic control unit, said first sensor being configured to detect a first piece of data indicative of a current torque applied to the thread collection and supply unit;

s second sensor electrically connected to the electronic control unit, said second sensor being configured to detect a second piece of data indicative of a current tension value of the thread supplied to the textile machine, the method comprising the following steps continuously carried out during an operation time interval of the supply device:

providing the electronic control unit with said first piece of data and said second piece of data;

calculating, by the electronic control unit, a first numeric indicator representative of torque values applied to the electric motor to move the thread collection and supply unit, each variation of the first numeric indicator in said operation time interval being representative of a variation of the torque value applied to the motor to compensate for a deviation of the first piece of data detected from a first pre-set torque reference value;

calculating, by the electronic control unit, a second numeric indicator representative of tension values applied to the thread supplied to the textile machine, each variation of the second numeric indicator in said operation time interval being representative of a deviation of the second piece of data detected from a second pre-set reference value of the tension of the thread supplied to the textile machine;

detecting, based on analysis of said first and second numeric indicator performed by the electronic control unit, malfunctions in the unwinding of the thread from the reel and in the supply of the thread to the textile machine;

signaling, by the electronic control unit, occurrence of said malfunctions, wherein said step of detecting malfunctions comprises a step of detecting a first type of malfunction and a second type of malfunction, said step of signaling the occurrence of said malfunctions comprises a step of providing a first type of signaling and a second type of signaling.

2. The method for monitoring and controlling according to claim 1, wherein said step of calculating the first numeric indicator comprises a step of equalizing the first numeric indicator to an average value of the torque applied by the electric motor to move the thread collection and supply unit of the supply device.

3. The method for monitoring and controlling according to claim 1, wherein said step of calculating the first numeric indicator comprises a step of equalizing the first numeric indicator to a deviation from an average value of an instantaneous value of the torque applied by the electric motor to move the thread collection and supply unit of the supply device.

4. The method for monitoring and controlling according to claim 1, wherein said step of detecting the first type of malfunction in the unwinding of the thread from the reel comprises the steps of:

defining a first reference threshold for the values of the first numeric indicator;

comparing continuously, in the operation time interval of the supply device, by the electronic control unit, the values of the first numeric indicator calculated with said first threshold;

detecting said first type of malfunction based on said comparison.

5. The method for monitoring and controlling according to claim 4, wherein said step of signaling the occurrence of said first type of malfunction in the unwinding of the thread from the reel comprises the step of providing the first type of signaling when the values of the first numeric indicator exceed said first threshold.

6. The method for monitoring and controlling according to claim 4, wherein said step of detecting the second type of malfunction in the unwinding of the thread from the reel comprises the steps of:

defining a second reference threshold for the values of the first numeric indicator greater than said first threshold;

comparing continuously, in the operation time interval of the supply device, by the electronic control unit, the values of the first numeric indicator calculated with said second threshold;

detecting said second type of malfunction based on said comparison.

7. The method for monitoring and controlling according to claim 6, wherein said step of signaling the occurrence of said second type of malfunction in the unwinding of the thread from the reel comprises the step of providing the second type of signaling when the values of the first numeric indicator exceed said second threshold.

8. The method for monitoring and controlling according to claim 4, wherein said step of signaling the occurrence of said first type of malfunction in the unwinding of the thread from the reel comprises the steps of:

defining a first time interval within the operation time interval of the supply device, said first time interval having a first duration;

providing the first type of signaling when the values of the first numeric indicator exceed said first threshold for a second time interval having a duration less than the duration of the first time interval.

9. The method for monitoring and controlling according to claim 8, wherein said step of signaling the occurrence of said second type of malfunction in the unwinding of the thread from the reel comprises the step of providing the second type of signaling when the values of the first numeric indicator exceed said first threshold for a third time interval having duration greater than the duration of the first time interval.

10. The method for monitoring and controlling according to claim 1, wherein said step of calculating the second numeric indicator comprises the steps of:

calculating, from said second piece of data detected by the second sensor, instantaneous and averaged values of the measured tension of the thread supplied to the textile machine;

calculating an average fluctuation and an instantaneous fluctuation of said tension of the thread, said second numeric indicator coinciding with a deviation of the instantaneous fluctuation of the tension of the thread from said average fluctuation.

11. The method for monitoring and controlling according to claim 1, wherein the step of detecting the first type of malfunction of the supply of the thread to the textile machine comprises the steps of:

defining a third reference threshold for the values of the second numeric indicator;

comparing continuously, in the operation time interval of the supply device, by the electronic control unit, the values of the calculated second numeric indicator with said third threshold;

detecting said first type of malfunction based on said comparison.

12. The method for monitoring and controlling according to claim 11, wherein said step of signaling the occurrence of said first type of malfunction in the supply of the thread to the textile machine comprises the step of providing the first type of signaling when the values of the second numeric indicator exceed said third threshold.

13. The method for monitoring and controlling according to claim 11, wherein said step of detecting the second type of malfunction in the supply of the thread to the textile machine comprises the steps of:

defining a fourth reference threshold for the values of the second numeric indicator greater than said third threshold;

comparing continuously, in the operation time interval of the supply device, by the electronic control unit, the values of the calculated second numeric indicator with said fourth threshold;

detecting said second type of malfunction based on said comparison.

14. The method for monitoring and controlling according to claim 13, wherein said step of signaling the occurrence of said second type of malfunction in the supply of the thread to the textile machine comprises the step of providing the second type of signaling when the values of the second numeric indicator exceed said fourth threshold.

15. The method for monitoring and controlling according to claim 11, wherein said step of signaling the occurrence of said first type of malfunction in the supply of the thread to the textile machine comprises the steps of:

defining a further first time interval within the operation time interval of the supply device, said further first time interval having a first duration;

providing the first type of signaling when the values of the second numeric indicator exceed said third threshold for a further second time interval having a duration less than the first duration of the further first time interval.

16. The method for monitoring and controlling according to claim 15, wherein said step of signaling the occurrence of said second type of malfunction in the supply of the thread to the textile machine comprises the step of providing the second type of signaling when the values of the second numeric indicator exceed said third threshold for a further third time interval having a duration greater than the first duration of the further first time interval.

17. The method for monitoring and controlling according to claim 4, wherein said value thresholds are pre-set or programmable.

18. The method for monitoring and controlling according to claim 8, wherein the duration of the first time interval is pre-set or programmable.

19. The method for monitoring and controlling according to claim 1, wherein said first type and said second type of signaling are selected from the group consisting of:

sending a warning upon occurrence of the malfunction;

stopping the textile machine.

20. The method for monitoring and controlling according to claim 19, wherein said step of sending a warning comprises a step of activating a visual signal provided on the supply device.

21. The method for monitoring and controlling according to claim 1, further comprising a step of displaying said first and second numeric indicator on a display interface associated with said supply device or associated with multimedia devices for controlling the productive process connected to the supply device, said multimedia devices being selected in the group consisting of:

a tablet, a laptop, a smartwatch.

22. The method for monitoring and controlling according to claim 1, wherein said step of signaling the occurrence of a malfunction in the unwinding of the thread from the reel or in the supply of the thread to the textile machine comprises a step of transmitting, by the electronic control unit, a piece of multimedia warning information on a display interface associated with the supply device or associated with multimedia devices for controlling a productive process connected to the supply device, said multimedia devices being selected from the group consisting of:

a tablet, a laptop, a smartwatch.

23. The method for monitoring and controlling according to claim 1, wherein said supply device operates at constant speed and is configured to compensate for thread tension variations, and wherein said step of detecting malfunctions comprises a step of detecting periodic variations of the first numeric indicator indicative of the presence of a broken or deformed needle in said textile machine.

24. The method for monitoring and controlling according to claim 1, wherein said supply device operates at constant speed and is configured to preclude compensating for thread tension variations, and wherein said step of detecting malfunctions comprises a step of detecting periodic variations of the second numeric indicator indicative of presence of a broken or deformed needle or malfunctions in other elements involved in formation of a stitch in said textile machine.

25. A supply device configured to monitor and control the unwinding of a thread from a reel and the supply of said thread to a textile machine, comprising:

an electronic control unit;

a thread collection and supply unit configured to assist the winding of the thread taken from the reel, said thread collection and supply unit being moved by an electric motor driven by the electronic control unit;

a first sensor associated with the thread collection and supply unit and electrically connected to the electronic control unit, said first sensor being configured to detect a first piece of data indicative of a current torque applied to the thread collection and supply unit;

a second sensor electrically connected to the control unit, said second sensor being configured to detect a second piece of data indicative of a current tension value of the thread supplied to the textile machine, said electronic control unit being configured to carry out the steps of continuously carrying out during an operation time interval of the supply device:

providing the electronic control unit with said first piece of data and said second piece of data;

calculating, by the electronic control unit, a first numeric indicator representative of torque values applied to the electric motor to move the thread collection and supply unit, each variation of the first numeric indicator in said operation time interval being representative of a variation of the torque value applied to the motor to compensate for a deviation of the first piece of data detected from a first pre-set torque reference value;

calculating, by the electronic control unit, a second numeric indicator representative of tension values applied to the thread supplied to the textile machine, each variation of the second numeric indicator in said operation time interval being representative of a deviation of the second piece of data detected from a second pre-set reference value of the tension of the thread supplied to the textile machine;

detecting, based on analysis of said first and second numeric indicator performed by the electronic control unit, malfunctions in the unwinding of the thread from the reel and in the supply of the thread to the textile machine;

signaling, by the electronic control unit, occurrence of said malfunctions, wherein said step of detecting malfunctions comprises a step of detecting a first type of malfunction and a second type of malfunction, said step of signaling the occurrence of said malfunctions comprises a step of providing a first type of signaling and a second type of signaling.

* * * * *